US011648444B2

(12) United States Patent
Wattenberg

(10) Patent No.: US 11,648,444 B2
(45) Date of Patent: May 16, 2023

(54) FITNESS DEVICE FOR EXERCISE AND BALANCE DEVELOPMENT

(71) Applicant: Julie Ann Wattenberg, Plainfield, IL (US)

(72) Inventor: Julie Ann Wattenberg, Plainfield, IL (US)

( * ) Notice: Subject to any disclaimer, the term of this patent is extended or adjusted under 35 U.S.C. 154(b) by 21 days.

(21) Appl. No.: 17/332,241

(22) Filed: May 27, 2021

(65) Prior Publication Data

US 2021/0283466 A1 Sep. 16, 2021

Related U.S. Application Data

(63) Continuation of application No. 16/439,447, filed on Jun. 12, 2019, now Pat. No. 11,033,778.

(Continued)

(51) Int. Cl.
*A63B 26/00* (2006.01)
*A63B 21/02* (2006.01)

(Continued)

(52) U.S. Cl.
CPC ..... *A63B 26/003* (2013.01); *A47C 3/029* (2013.01); *A47C 4/54* (2013.01); *A47D 13/102* (2013.01);

(Continued)

(58) Field of Classification Search
CPC .. A47C 3/029; A47C 3/12; A47C 3/16; A47C 4/54; A47D 13/102; A63B 21/0004; A63B 21/00058; A63B 21/00069; A63B 21/00178; A63B 21/00181; A63B 21/00185; A63B 21/002; A63B 21/0023; A63B 21/008; A63B 21/0084; A63B 21/0085; A63B 21/0088; A63B 21/012; A63B 21/0125; A63B 21/02; A63B 21/028; A63B 21/04; A63B 21/0407; A63B 21/0414; A63B 21/0421; A63B 21/0428; A63B 21/0435; A63B 21/0442; A63B 21/05; A63B 21/0602; A63B 21/0607; A63B 21/068; A63B 21/4023; A63B 21/4027; A63B 21/4029; A63B 21/4031; A63B 21/4033; A63B 21/4035; A63B 21/4039; A63B 21/4043; A63B 26/00; A63B 26/003; A63B 41/00; A63B 41/08; A63B 41/085; A63B 41/10; A63B 41/125;

(Continued)

(56) References Cited

U.S. PATENT DOCUMENTS 2,574,046 A 11/1951 Logan
2,698,028 A 12/1954 Lee et al.

(Continued)

*Primary Examiner* — Gary D Urbiel Goldner
(74) *Attorney, Agent, or Firm* — Moore & Van Allen PLLC; W. Kevin Ransom; R. W. McCord Rayburn

(57) ABSTRACT

A fitness device is provided, the fitness device comprising: an elastomeric member having an interior cavity, the elastomeric member comprising a cylindrical portion extending between a first hemispherical endcap and a second hemispherical endcap, wherein a surface of the elastomeric member defines an aperture positioned between the interior cavity and an exterior of the elastomeric member; and a structured surface positioned on the surface of the elastomeric member over the aperture, the structured surface extending into the interior cavity of the elastomeric member.

20 Claims, 10 Drawing Sheets

Related U.S. Application Data

(60) Provisional application No. 62/684,555, filed on Jun. 13, 2018.

(51) Int. Cl.

| | |
|---|---|
| ***A63B 21/00*** | (2006.01) |
| ***A47D 13/10*** | (2006.01) |
| ***A47C 4/54*** | (2006.01) |
| ***A47C 3/029*** | (2006.01) |
| ***A63B 41/08*** | (2006.01) |

(52) U.S. Cl.
CPC ..... *A63B 21/028* (2013.01); *A63B 21/4033* (2015.10); *A63B 41/08* (2013.01); *A63B 2209/00* (2013.01); *A63B 2225/62* (2013.01)

(58) Field of Classification Search
CPC . A63B 2041/005; A63B 43/00; A63B 43/002; A63B 43/04; A63B 71/0009; A63B 71/0054; A63B 71/0619; A63B 2071/0063; A63B 2071/0072; A63B 2071/0655; A63B 2208/0228; A63B 2208/0233; A63B 2208/12; A63B 2209/00; A63B 2209/14; A63B 2210/00; A63B 2210/02; A63B 2225/60; A63B 2225/605; A63B 2225/62
See application file for complete search history.

(56) References Cited

U.S. PATENT DOCUMENTS

| | | | | |
|---|---|---|---|---|
| 2,987,735 | A | 6/1961 | Nail | |
| 3,460,828 | A | 8/1969 | Curlee | |
| 3,495,874 | A | 2/1970 | Dean | |
| 3,498,614 | A | 3/1970 | Carter, Jr. | |
| 3,635,528 | A | 1/1972 | Strom | |
| 3,700,237 | A | 10/1972 | Kopp | |
| 3,958,801 | A | 5/1976 | Correa | |
| 4,141,588 | A | 2/1979 | Anderson | |
| 4,531,737 | A | 7/1985 | Jacobson et al. | |
| 5,098,095 | A | 3/1992 | Weiss | |
| 6,375,601 | B1 | 4/2002 | Johnson | |
| 8,382,647 | B1 | 2/2013 | Hodes et al. | |
| 11,033,778 | B2 * | 6/2021 | Wattenberg | A63B 41/08 |
| 2003/0100417 | A1 | 5/2003 | Westwood | |
| 2006/0217248 | A1 | 9/2006 | Diseati | |
| 2007/0040427 | A1 | 2/2007 | Cohen | |
| 2012/0258841 | A1 | 10/2012 | James | |
| 2013/0026801 | A1 | 1/2013 | Goldman et al. | |
| 2014/0265515 | A1 | 9/2014 | Harter | |
| 2015/0150378 | A1 | 6/2015 | Lee | |
| 2015/0150380 | A1 | 6/2015 | Oh et al. | |
| 2015/0150381 | A1 | 6/2015 | Lee | |
| 2019/0381358 | A1 * | 12/2019 | Wattenberg | A47D 13/102 |

* cited by examiner

FITNESS DEVICE FOR EXERCISE AND BALANCE DEVELOPMENT

CROSS-REFERENCE TO RELATED APPLICATIONS

The present application claims the benefit of U.S. patent application Ser. No. 16/439,447 for a "Fitness Device for Exercise and Balance Development" filed Jun. 12, 2019 (and published Dec. 19, 2019 as U.S. Patent Application Publication No. 2019/0381358), now U.S. Pat. No. 11,033,778, which claims the benefit of U.S. Provisional Application No. 62/684,555 for a "Fitness Device for Exercise and Balance Development" filed Jun. 13, 2018. The contents of each of the above-referenced applications, publication, and patent are hereby incorporated by reference herein in their entirety.

FIELD OF THE INVENTION

The present invention relates to the field of fitness devices. In particular, the field of exercise devices for developing balance and providing stabilization.

BACKGROUND

Exercise balance balls not only assist in fitness development, but can also provide a seating option alternative to traditional desk chairs. When used in place of traditional chairs, balance balls assist in developing a user's balance, stabilization, and body strength, while the user focuses on maintaining a proper seated position. This is especially beneficial for children as the typically inflated ball provides an outlet for idle energy while simultaneously developing their physical health. Furthermore, users with disabilities (e.g., cerebral palsy) may benefit from the added sensory input of an exercise ball over a regular chair. However, due to the spherical design of traditional exercise balls, loss of user balance in any direction while seated on the ball may cause distraction and even lead to potential injury. As such, there is a need for an improved exercise ball design that provides a dedicated support and stabilization structure to increase safety of a user.

BRIEF SUMMARY

The following presents a simplified summary of one or more embodiments of the invention to thereby provide a basic understanding of such embodiments. This summary is not an extensive overview of all contemplated embodiments, and is intended to neither identify key or critical elements of all embodiments, nor delineate the scope of any or all embodiments. Its sole purpose is to present some concepts of one or more embodiments in a simplified form as a prelude to the more detailed description that is presented later.

A fitness device is provided, the fitness device comprising: a spheroidal member having an interior cavity, the spheroidal member comprising a cylindrical portion extending between a first hemispherical endcap and a second hemispherical endcap, wherein a surface of the spheroidal member defines an aperture positioned between the interior cavity and an exterior of the elastomeric member; and a structured surface positioned on the surface of the spheroidal member over the aperture, the structured surface extending into the interior cavity of the spheroidal member.

In a specific embodiment, the spheroidal member has a central axis, and the spheroidal member is shaped to limit movement of the fitness device along a resting surface in a direction non-perpendicular to the central axis.

In another embodiment, the spheroidal member further comprises an elastomeric material, wherein the spheroidal member is recoverably deformable. In yet another embodiment, the spheroidal member is inflatable and further comprises a valve configured for transferring air into the interior cavity of the spheroidal member.

In yet another embodiment, the surface of the spheroidal member comprises a textured surface. In yet another embodiment, the textured surface comprises at least one rib or stud.

In yet another embodiment, the structured surface is sealed to the spheroidal member about the aperture. In yet another embodiment, the aperture and the structured surface are positioned on the cylindrical portion of the elastomeric member. In yet another embodiment, the structured surface further comprises: a first rigid portion and a second rigid portion each extending from the surface of the elastomeric member to join at a shared edge within the interior cavity; and a side wall, wherein the first rigid portion, the second rigid portion, and the side wall form an externally accessible compartment within the interior cavity, and wherein the first rigid portion and the second rigid portion are not parallel.

A fitness device is also provided, the fitness device comprising: an elastomeric member having an interior cavity and a surface, the surface defining an aperture; and a structured surface positioned on the surface of the elastomeric member over the aperture, the structured surface comprising: a first rigid portion and a second rigid portion each extending from the surface of the elastomeric member to join at a shared edge within the interior cavity; and a side wall, wherein the first rigid portion, the second rigid portion, and the side wall form an externally accessible compartment within the interior cavity, and wherein the first rigid portion and the second rigid portion are not parallel.

In a specific embodiment, the first rigid portion is perpendicular to the second rigid portion. In another embodiment the structured surface is shaped to follow the curvature of the surface of the elastomeric member. In yet another embodiment, the elastomeric member has a central axis, and wherein the first rigid portion and the second rigid portion extend toward the central axis. In yet another embodiment, the structured surface is sealed to the elastomeric member about the aperture.

In yet another embodiment, the structured surface forms a seat configured to provide support to a user. In yet another embodiment, at least one of the first rigid portion and the second rigid portion are contoured to conform to a body of the user.

In yet another embodiment, the elastomeric member comprises a cylindrical portion extending between a first hemispherical endcap and a second hemispherical endcap. In yet another embodiment, the aperture and the structured surface are positioned on the cylindrical portion of the elastomeric member.

A fitness device is also provided, the fitness device comprising: an elastomeric oblong member having an interior cavity and a surface, the surface defining an aperture; and a rigid structure positioned within the aperture, the rigid structure extending into the interior cavity of the elastomeric oblong member.

In a specific embodiment, the elastomeric oblong member has a spheroidal shape, an ellipsoidal shape, a cylindrical shape, a dumbbell shape, or an hourglass shape.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

Figure 1:
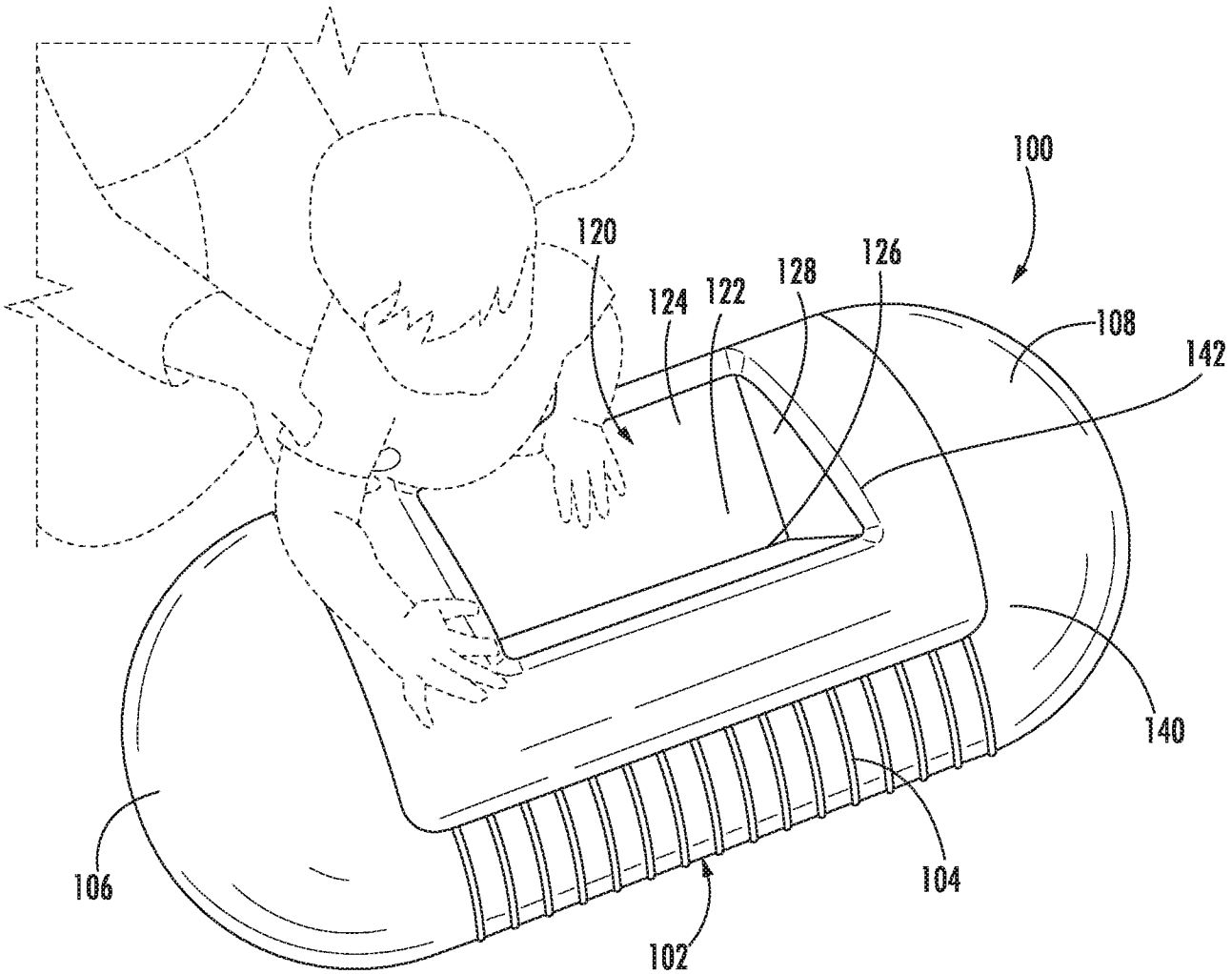
Figure 2A:
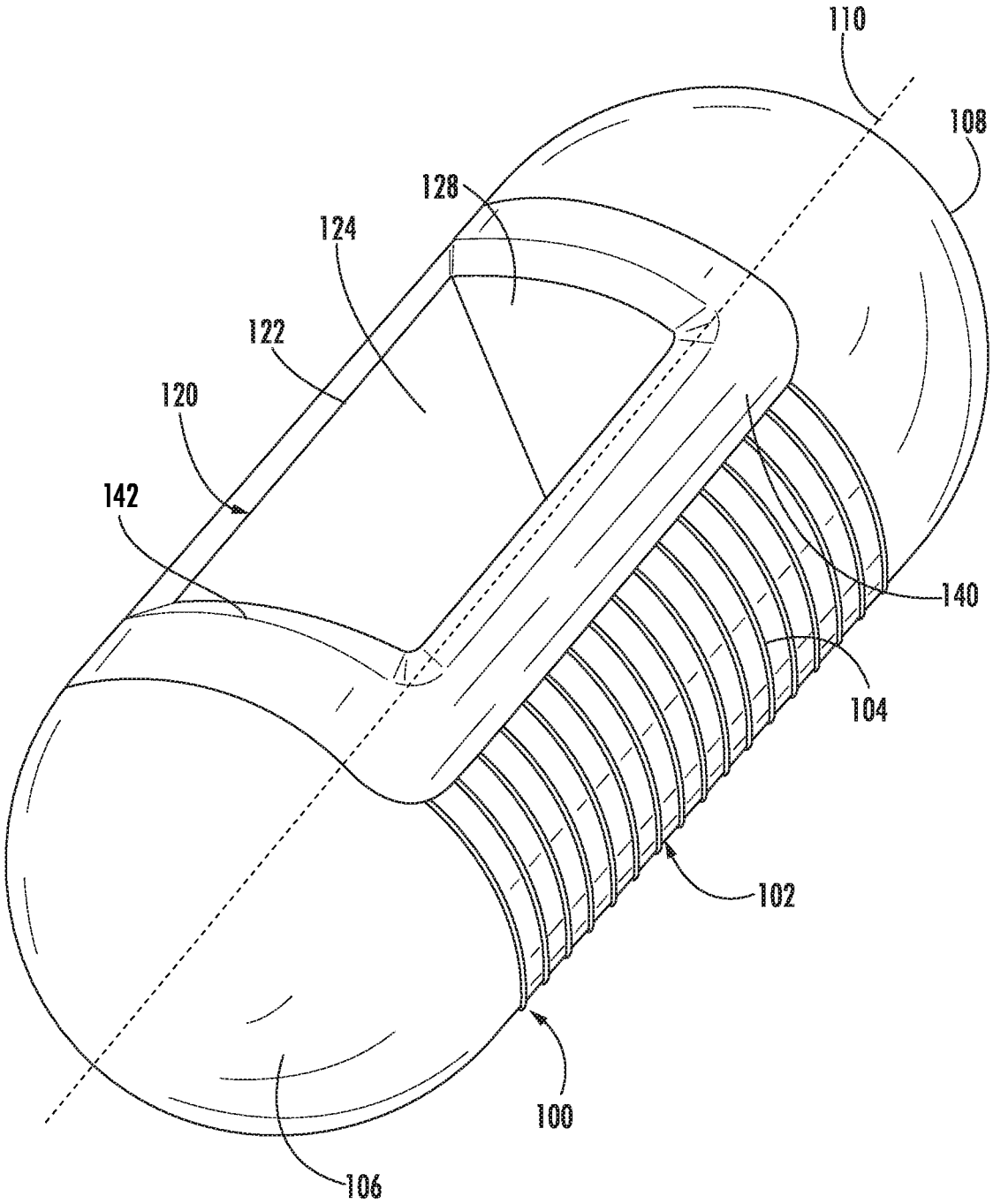
Figure 2B:
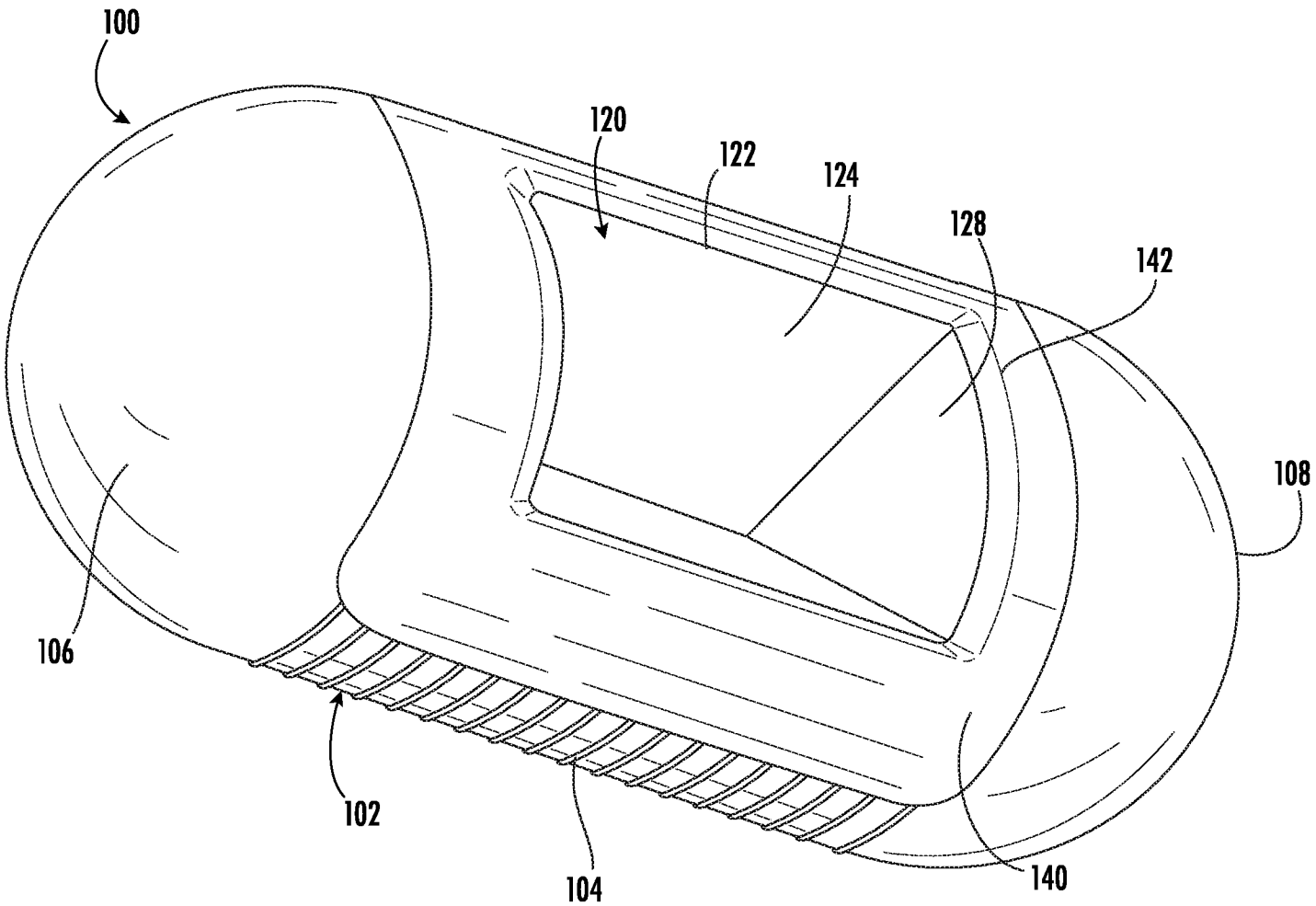
Figure 2C:
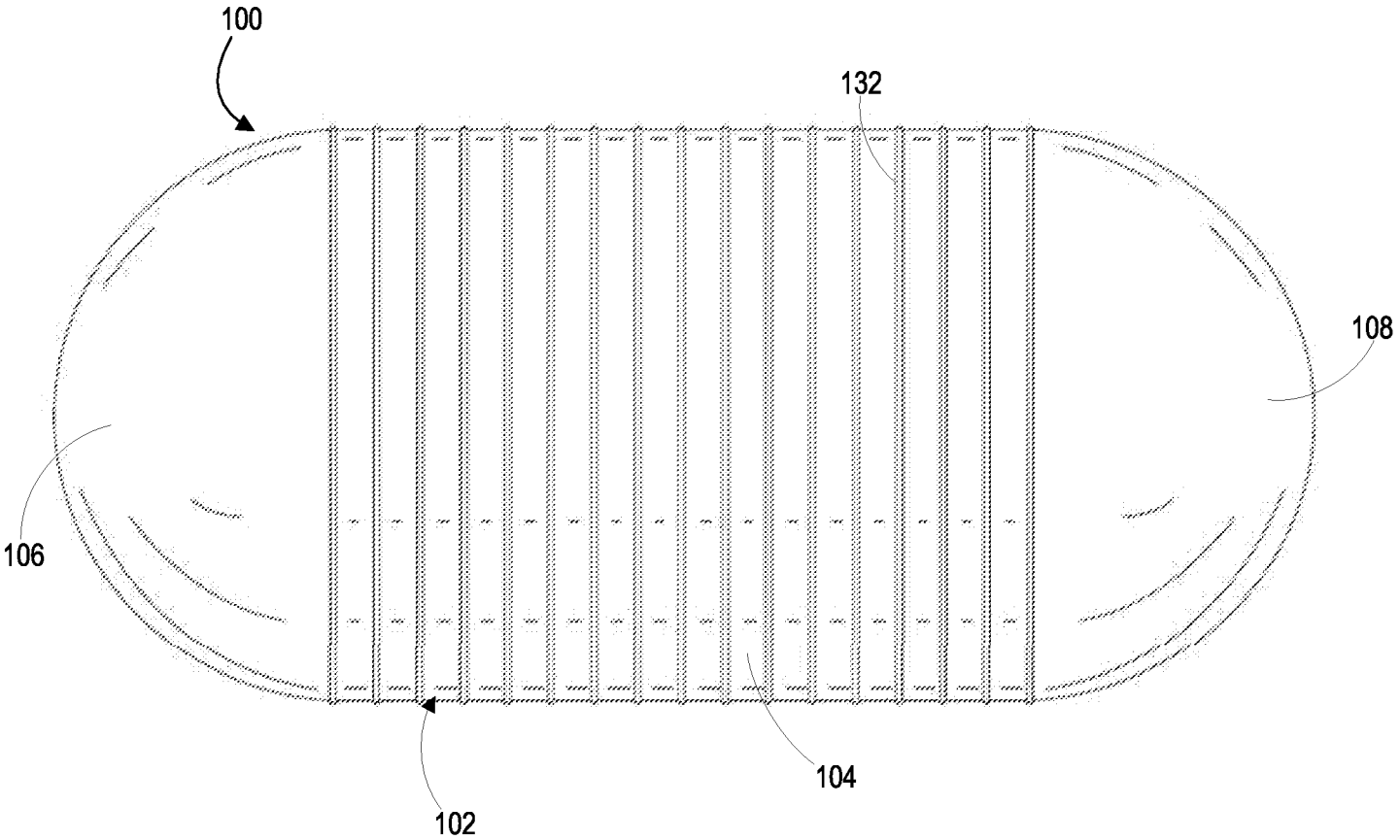
Figure 2D:
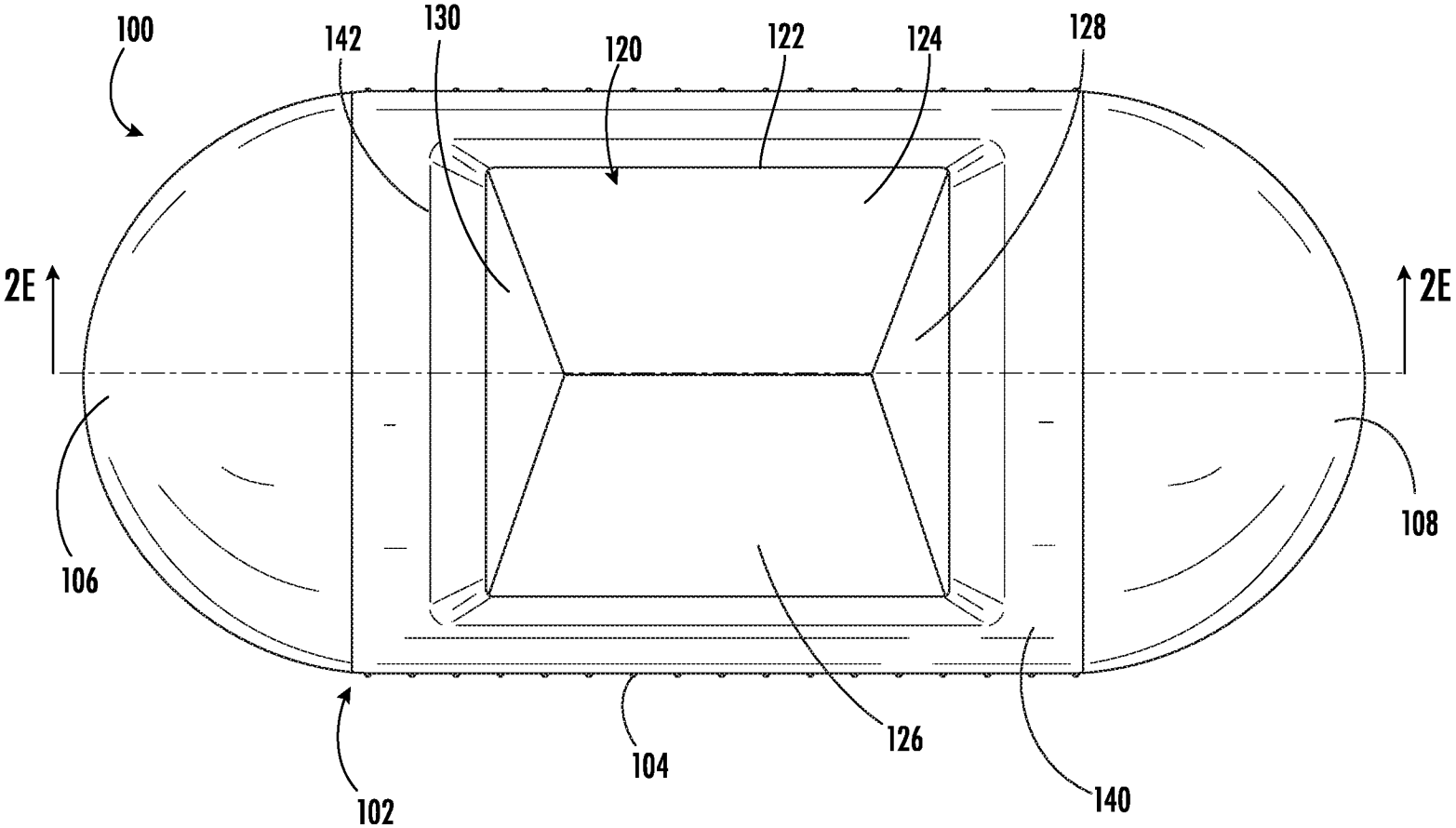
Figure 2E:
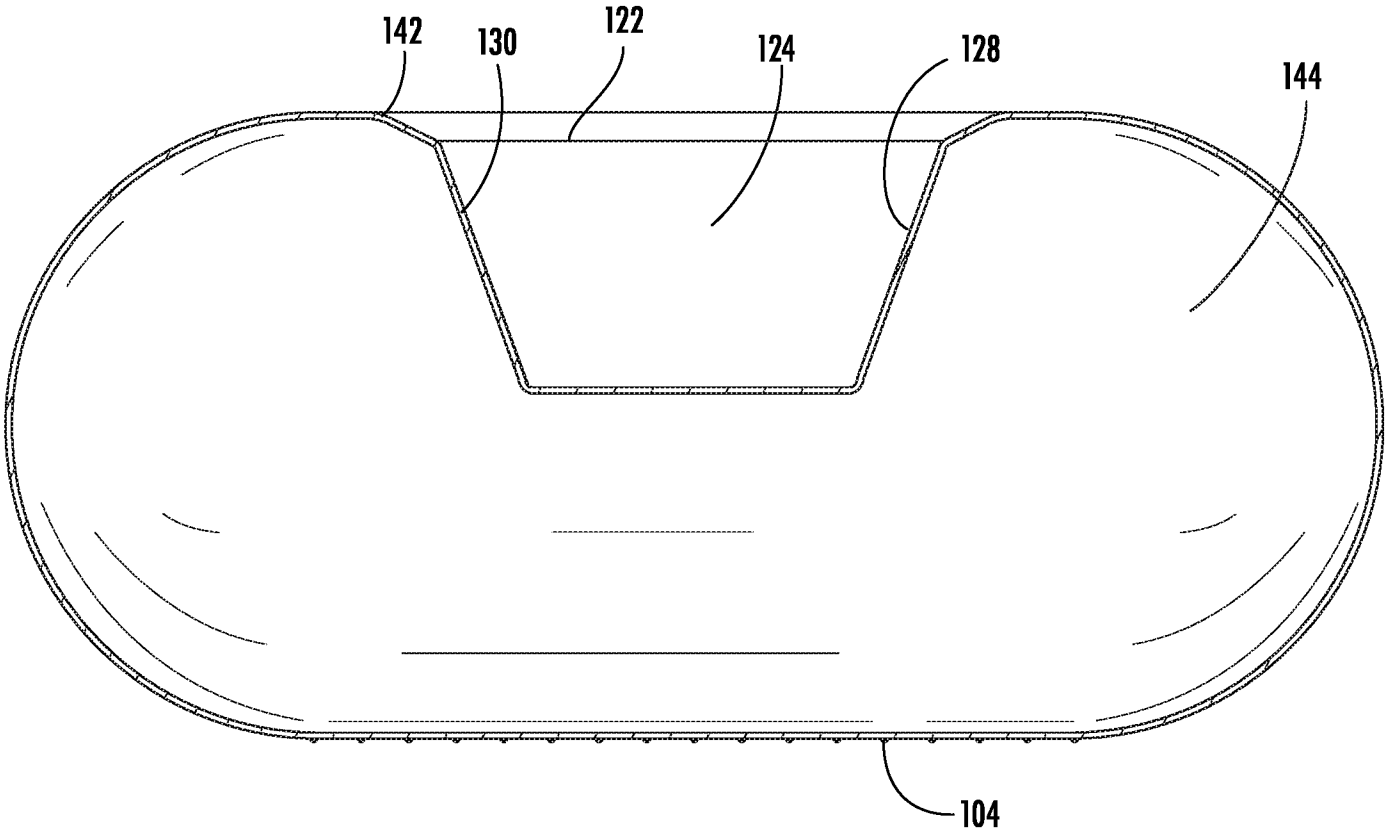
Figure 3:
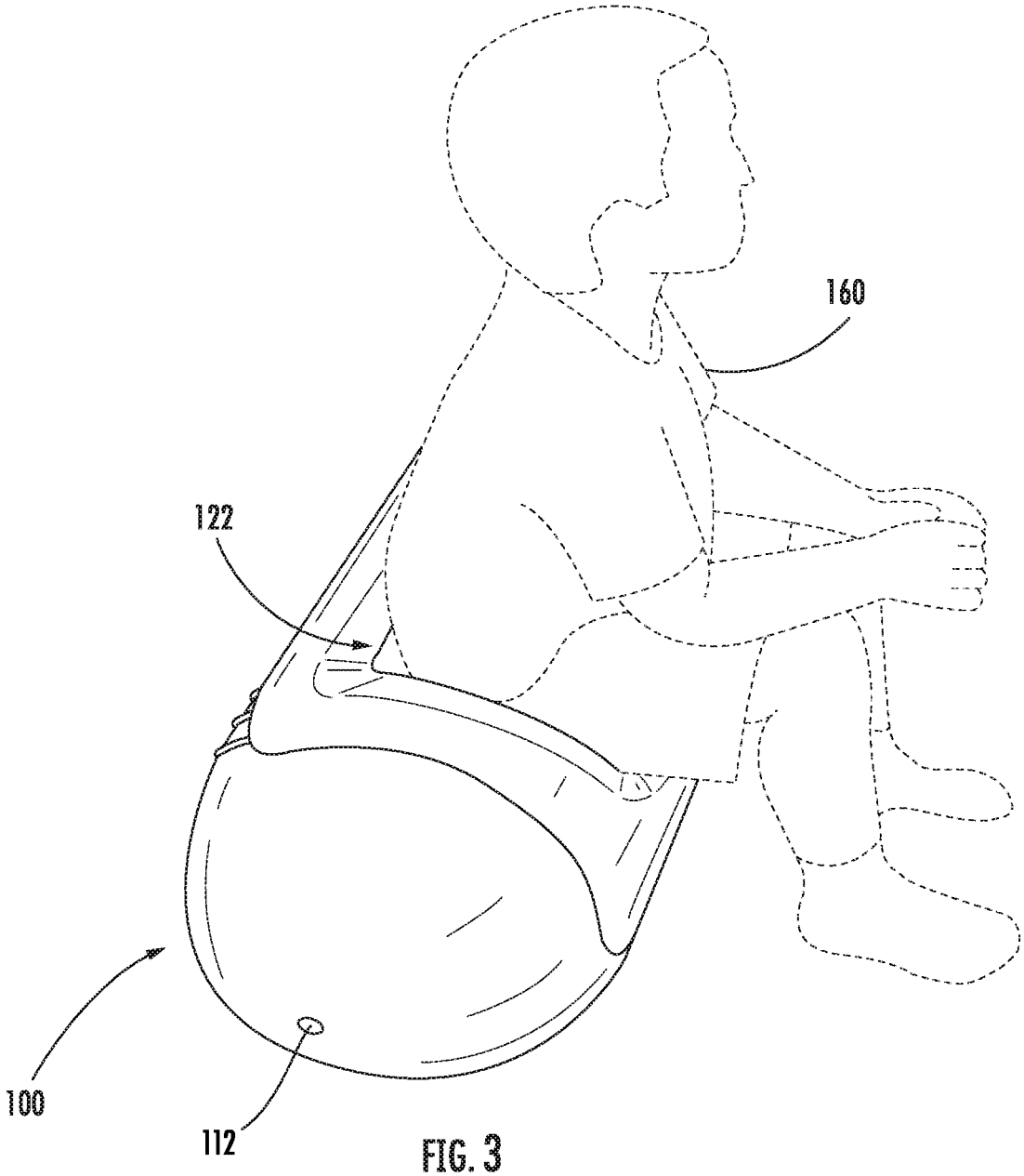
Figure 4:
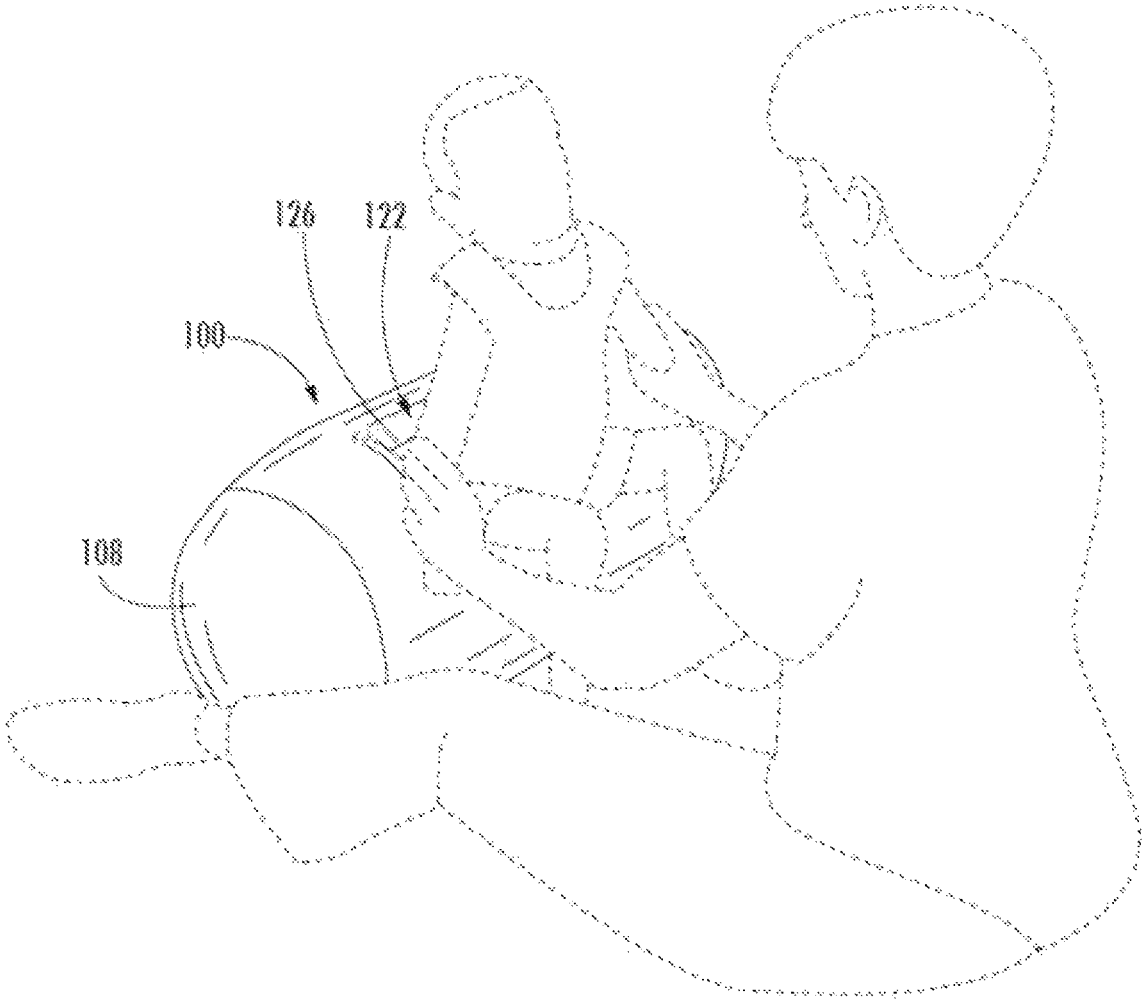
Figure 5:
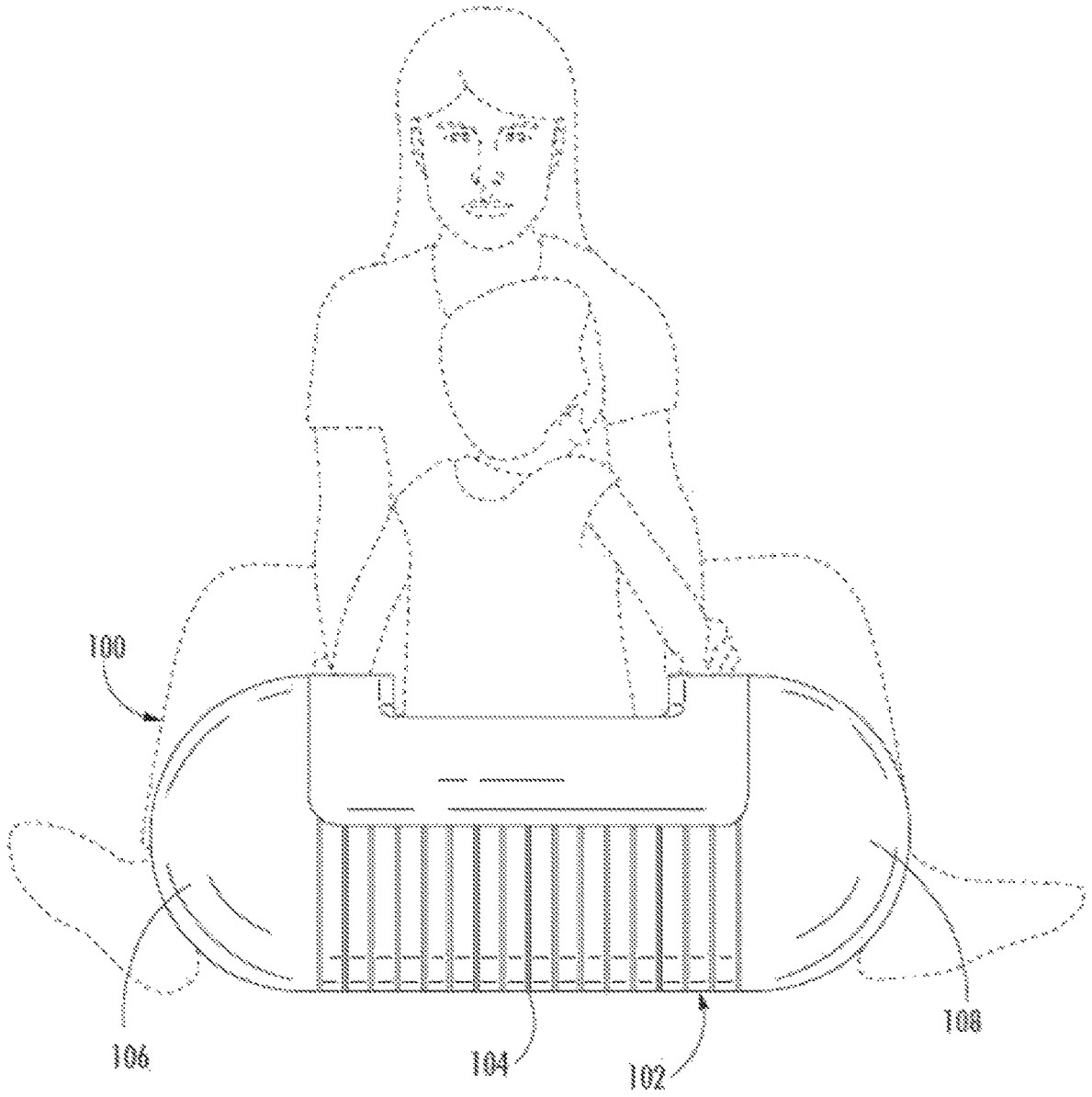
Figure 6:
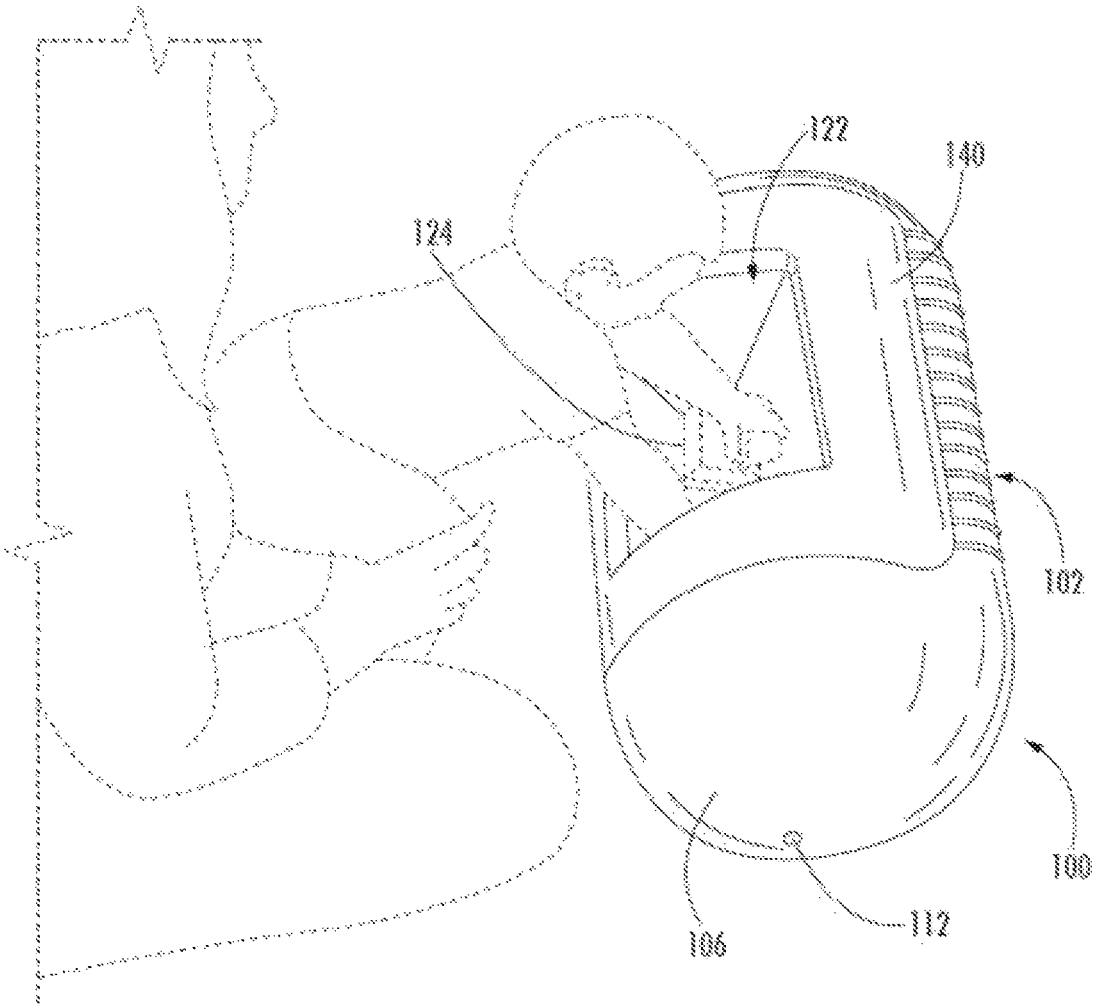

Having thus described embodiments of the invention in general terms, reference will now be made to the accompanying drawings, wherein:

FIG. 1 depicts a perspective view of a fitness device, in accordance with one embodiment of the invention;

FIG. 2A depicts a perspective view of a fitness device, in accordance with one embodiment of the invention;

FIG. 2B depicts a perspective view of a fitness device, in accordance with one embodiment of the invention;

FIG. 2C depicts a bottom view of a fitness device, in accordance with one embodiment of the invention;

FIG. 2D depicts a top view of a fitness device and a structured surface, in accordance with one embodiment of the invention;

FIG. 2E depicts a cross-sectional view of a fitness device, in accordance with one embodiment of the invention;

FIG. 3 depicts a perspective view of a fitness device used as a chair, in accordance with one embodiment of the invention;

FIG. 4 depicts a perspective view of a fitness device used as a chair, in accordance with one embodiment of the invention;

FIG. 5 depicts a rear view of a fitness device used as a chair, in accordance with one embodiment of the invention; and FIG. 6 depicts a perspective view of a structured surface of a fitness device, in accordance with one embodiment of the invention.

DETAILED DESCRIPTION OF THE INVENTION

Embodiments of the invention are directed to a fitness device for providing support and stabilization while developing strength and balance in users, and in particular, children and those with disabilities. In one embodiment, the fitness device generally has a capsule-like shape for limiting motion (i.e., rolling) of the device in one or more directions, thus reducing the chance of accidental loss of balance and potential injury from falling. Furthermore, the device, in one embodiment, is inflatable and made of an elastomeric material, which provides tactile feedback and a stimulating sensory response to users. The device further incorporates a structured surface which may be used as a seat to provide further stabilization for a user seated on the fitness device.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. In the drawings, like reference characters and numbers refer to like elements throughout. Also, the drawings are not necessarily to scale, emphasis instead generally being placed upon illustrating the principles of the disclosure. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa.

It should be understood that "operatively coupled," as used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Furthermore, operatively coupled components may mean that the components retain at least some freedom of movement in one or more directions or may be rotated about an axis (i.e., rotationally coupled, pivotally coupled).

A "user" as used herein may refer to any entity or individual associated with the fitness device. In one embodiment, the user is be an individual directly interacting with the fitness device (i.e., sitting, using for support, etc.). In another embodiment, the user is an individual providing additional support to another individual directly interacting with the fitness device. In one embodiment, the user is a child. In yet another embodiment, the user is an individual with a disability or injury. In some embodiments, the user is an individual utilizing the fitness device for stabilization support, sensory input, muscle and balance development, or the like.

FIG. 1-6 depict a collection of views of a fitness device 100, in accordance with one embodiment of the invention. The fitness device 100 generally includes a spheroidal or oblong member 102 and a structured surface 122 located within an aperture 142 of the spheroidal member 102. In the illustrated embodiment, the spheroidal member 102 has a capsule-like shape, wherein the member 102 further includes a cylindrical middle portion 104 extending between a first endcap 106 and a second endcap 108. The endcaps 106 and 108 are approximately hemispherical. In a particular embodiment, the spheroidal member 102 is approximately 32 inches in length and 21 inches in diameter. It should be understood that in alternative embodiments, the spheroidal member 102 may have larger or smaller dimensions to accommodate users of a variety of sizes (e.g., adult-sized).

It should also be understood that in alternative embodiments, the spheroidal member 102 may embodied as other shapes. In one embodiment, the spheroidal member 102 is an ellipsoidal shape. In another embodiment, the spheroidal member 102 is a spherical shape. In yet another embodiment, the spheroidal member 102 has multiple spherical elements (e.g., dumbbell-shaped). In yet another embodiment, the member 102 may have endcaps 106 and 108 that are flat or non-spherical (e.g., cylindrical, hourglass-shaped, or the like).

Due to the spheroidal or oblong shape of the fitness device 100, the fitness device is generally limited to a rolling motion along a surface in only directions approximately perpendicular to a longitudinal, central axis 110 of the spheroidal member 102. By limiting the directions of possible movement of the fitness device 100 along the surface, the potential for accidental injury from a user's spontaneous loss of balance may be reduced when compared to traditional exercise balance balls.

The spheroidal member 102 further includes a hollow, interior cavity 144 and is inflatable. Air may be transferred into the interior cavity 144 of the spheroidal member 102 via a valve 112. The spheroidal member 102 is made of an elastomeric, recoverably deformable material (e.g., polyvinylchloride (PVC)) that is also durable and of a sufficient thickness to prevent air leakage or bursting of the spheroidal member 102 during inflation or use. Due to the inflatable and elastic natures of the spheroidal member 102, the fitness device 100 is generally soft, lightweight, and recoverably deformable under an applied force of a user (e.g., sitting, bouncing, squeezing, rolling, etc.). In an alternative embodiment, the spheroidal member 102 is a solid member and does not include an interior cavity 144, wherein the spheroidal member 102 is made from a solid material (e.g., foam rubber or the like). In another embodiment, the spheroidal member 102 has a textured surface (e.g., studded, ribbed, etc.). For example, as illustrated in FIG. 2C, in one embodiment, the spheroidal member 102 comprises one or more ribs 132 encircling the cylindrical middle portion of the 104. In another embodiment, the spheroidal member 102 is formed of a structural material with a hollow interior, where the structural material is of sufficient rigidity to withstand the weight of the user on its own without collapsing.

The spheroidal member 102 further comprises an aperture 142 positioned on the surface of the member 102. In the illustrated embodiment, the aperture 142 is positioned between the endcaps 106 and 108 at a midpoint along the surface of the member 102. A structured surface 122 is positioned within the aperture 142 of the spheroidal member 102. The structured surface 122 is operatively coupled to the spheroidal member 102 about the edges of the aperture 142. In one embodiment, a tape or heat-seal 140 extends over the joined edges of both the structured surface 122 and the spheroidal member 102 to operatively couple the structured surface 122 to the spheroidal member 102, wherein an air-tight seal is formed over and/or between the joined edges.

In the illustrated embodiment, the structured surface 122 includes a first surface 124, a second surface 126, a first side wall 128, and a second side wall 130 that partially extend into the interior cavity 144 of the spheroidal member 102 to form an externally accessible cavity or compartment 120. The first 124 and second 126 surfaces or portions of the structured surface 122 extend into the interior of the spheroidal member 102 approximately perpendicular to the surface of the spheroidal member 102 from the edges of the aperture 142 toward the central axis 110 of the spheroidal member 102. Said another way, the first 124 and second 126 surfaces extend radially from the surface of the spheroidal member 102 towards the interior cavity 144. The first 124 and second 126 surfaces meet or join together at a shared edge within the interior of the member 102 at an angle of approximately 90° relative to one another. The side walls 128 join the remaining edges of the first 124 and second 126 surfaces to the spheroidal member 102 to form the cavity 120. The edges of the side walls 128 are curved to generally follow the curvature of the spheroidal member 102 where the side walls 128 couple to the surface of the spheroidal member 102.

In a specific embodiment the first 124 and second 126 surfaces of the structured surface 122 each have a length of 6 inches that extends into the interior of the spheroidal member 102 and a width of 10 inches that is coupled along the edge of the aperture 142. It should be understood that the components of the structured surface 122 may be embodied as having alternative dimensions, wherein the structured surface 122 may extend to a greater or lesser extent into the spheroidal member 102. Furthermore, in other embodiments, the first 124 and second 126 surfaces may be dimensioned so as to meet at an angle other than 90° so as to increase or decrease an opening of the formed cavity 120.

The structured surface 122 is made of a substantially rigid material (e.g. plastic) that is able to retain the shape of the cavity 120 even while under the influence of external forces (e.g., from the inflated spheroidal member 102 or from user interaction). In one embodiment, an exterior surface of the structured surface 122 is covered with the same material used to make the spheroidal member 102.

In some embodiments, the structured surface may be an integral part of the spheroidal member, where the portion of the spheroidal member defining the structured surface is structured to form a cavity and is rigid so as to support a user. In this embodiment, the portion of the spheroidal member forming the structured portion, could be formed with walls and structured seams to create the desired shape for the structured surface 122 with proper rigidity.

As illustrated in FIGS. 3-5, the structured surface 122 provides a seat within the cavity 120, wherein the fitness device 100 may be used as a chair by a user 160. The user 160 positions his or her backside within the cavity 120 and sits on the first surface 124 while the user's back is properly supported and oriented by the second surface 126 (as seen in FIG. 5). In one embodiment, at least one of the first surface 124 and second surface 126 are contoured to conform to a user's legs and/or back. The user 160 is partially retained in the seat of the cavity 120 by the side walls 128 of the structured surface 122. The user 160 may place his or her feet on the ground to further support the user 160 on the chair and prevent or control movement of the chair along the surface. In this way, the user 160 is enabled by the fitness device 100 to maintain or safely develop a sense of balance while safely sitting.

The user 160 is further enabled by the fitness device 100 to develop strength (e.g., leg and core) and balance through the active support and tactile feedback received from resisting rolling movement of the device 100 while maintaining a seated position. The user 160 may further receive a stimulating tactile response or sensory feedback from intentional movement of the device 100 along the surface due to the elastic nature of the device materials. For example, the user 160 may bounce in place while seated on the fitness device 100 or safely rock in directions permitted by the shape of the device 100. Alternatively, as illustrated in FIGS. 4 and 5, the user 160 may sit in the cavity 120 of the fitness device 100 while receiving additional support from another user to help maintain and develop balance.

As illustrated in FIG. 6, the structured surface 122 provides a platform or work space. For example, in the illustrated embodiment of FIG. 6, the cavity 120 formed by the structured surface 122 provides a table-like space in which a user (e.g., a child) may play or perform activities while actively supporting themselves with the fitness device 100 while standing or kneeling. In this way, a small child can develop his or her balance through the active support of the fitness device while the cavity 120 partially retains items (e.g., toys, building blocks, notebooks, etc.). In this way, the user 160 may be enabled by the fitness device 100 to develop strength and balance through the active support and tactile feedback received from the fitness device 100.

In alternative embodiments, the aperture 142 of the spheroidal member 102 may be positioned in other locations about the member 102. For example, the aperture 142 may be positioned on one of the endcaps 106, 108. In other embodiments, the spheroidal member 102 may have multiple apertures and/or structured surfaces 122 positioned about the spheroidal member 102. For example, in one embodiment, the fitness device 100 may include two cavities 120 providing back-to-back seats on a single fitness device 100, wherein two users may sit on the fitness device 100.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A fitness device comprising:

an elastomeric member having an interior cavity, a longitudinal central axis, and a surface, the surface defining an aperture, wherein the elastomeric member limits movement of the fitness device to a rolling motion approximately perpendicular to the longitudinal central axis; and a structured surface positioned within the aperture, the structured surface extending into the interior cavity of the elastomeric member.

2. The fitness device of claim 1, wherein the structured surface comprises at least one portion contoured to conform to a body of a user.

3. The fitness device of claim 1, wherein the elastomeric member further comprises an elastomeric material, and wherein the elastomeric member is recoverably deformable.

4. The fitness device of claim 1, wherein the structured surface is sealed to the elastomeric member about the aperture.

5. The fitness device of claim 1, wherein the aperture and the structured surface are positioned on a cylindrical portion of the elastomeric member.

6. The fitness device of claim 1, wherein the structured surface further comprises:

a first rigid portion and a second rigid portion each extending from the surface of the elastomeric member to join at a shared edge within the interior cavity; and a side wall, wherein the first rigid portion, the second rigid portion, and the side wall form an externally accessible compartment within the interior cavity, and wherein the first rigid portion and the second rigid portion are not parallel.

7. The fitness device of claim 1, wherein the elastomeric member is inflatable and further comprises a valve configured for transferring air into the interior cavity of the elastomeric member.

8. The fitness device of claim 1, wherein the surface of the elastomeric member comprises a textured surface.

9. The fitness device of claim 8, wherein the textured surface comprises at least one rib or stud.

10. A fitness device comprising:

an elastomeric member having an interior cavity, a longitudinal central axis, and a surface, the surface defining an aperture, wherein the elastomeric member limits movement of the fitness device to a rolling motion approximately perpendicular to the longitudinal central axis; and a structured surface positioned on the surface of the elastomeric member over the aperture, the structured surface comprising:

a first rigid portion and a second rigid portion each extending from the surface of the elastomeric member to join at a shared edge within the interior cavity; and a side wall, wherein the first rigid portion, the second rigid portion, and the side wall form an externally accessible compartment within the interior cavity, and wherein the first rigid portion and the second rigid portion are not parallel.

11. The fitness device of claim 10, wherein the first rigid portion is perpendicular to the second rigid portion.

12. The fitness device of claim 10, wherein the first rigid portion and the second rigid portion extend toward the longitudinal central axis.

13. The fitness device of claim 10, wherein the structured surface is shaped to follow a curvature of the surface of the elastomeric member.

14. The fitness device of claim 10, wherein the structured surface is sealed to the elastomeric member about the aperture.

15. The fitness device of claim 10, wherein the structured surface forms a seat configured to provide support to a user.

16. The fitness device of claim 15, wherein at least one of the first rigid portion and the second rigid portion are contoured to conform to a body of the user.

17. The fitness device of claim 10, wherein the elastomeric member comprises a cylindrical portion extending between a first hemispherical endcap and a second hemispherical endcap.

18. The fitness device of claim 17, wherein the aperture and the structured surface are positioned on the cylindrical portion of the elastomeric member.

19. A fitness device comprising:

an elastomeric member having an interior cavity and a longitudinal central axis the elastomeric member comprising a cylindrical portion extending between a first hemispherical endcap and a second hemispherical endcap, wherein a surface of the elastomeric member defines an aperture positioned between the interior cavity and an exterior of the elastomeric member, wherein the elastomeric member limits movement of the fitness device to a rolling motion approximately perpendicular to the longitudinal central axis; and a structured surface positioned on the surface of the elastomeric member over the aperture, the structured surface extending into the interior cavity of the elastomeric member.

20. The fitness device of claim 19, wherein the elastomeric member has a spheroidal shape, an ellipsoidal shape, a cylindrical shape, a dumbbell shape, or an hourglass shape.

* * * * *